US008469768B1

(12) United States Patent
Smith

(10) Patent No.: US 8,469,768 B1
(45) Date of Patent: Jun. 25, 2013

(54) CONFETTI PARTY HORN

(75) Inventor: Scott Smith, Carlisle, PA (US)

(73) Assignee: The Beistle Company, Shippensburg, PA (US)

( * ) Notice: Subject to any disclaimer, the term of this patent is extended or adjusted under 35 U.S.C. 154(b) by 1639 days.

(21) Appl. No.: 11/606,512

(22) Filed: Nov. 30, 2006

(51) Int. Cl.
*A63H 33/30* (2006.01)

(52) U.S. Cl.
USPC ..... 446/475; 446/209

(58) Field of Classification Search
USPC ..... 446/209, 475
See application file for complete search history.

(56) References Cited

U.S. PATENT DOCUMENTS

| | | | | |
|---|---|---|---|---|
| 1,153,207 | A | 9/1915 | Eisenberg | |
| 1,491,809 | A | 4/1924 | Macchia | |
| 1,560,326 | A | 11/1925 | Rutherford | |
| 1,623,106 | A | 4/1927 | Goldberg | |
| 2,607,162 | A | 8/1952 | Hoeflich | |
| 5,149,290 | A | 9/1992 | Reveen | |
| 5,531,628 | A | 7/1996 | Watkins | |
| 5,772,491 | A | 6/1998 | Watkins | |
| 5,823,850 | A | 10/1998 | Watkins | |
| 6,299,502 | B1 | 10/2001 | Cheng | |
| 6,364,737 | B1 | 4/2002 | Sterr et al. | |
| 6,394,320 | B1 | 5/2002 | Felman | |
| 6,447,364 | B1 | 9/2002 | Song | |
| 6,450,160 | B1 | 9/2002 | Fu et al. | |
| 6,641,458 | B1 | 11/2003 | Nofsinger et al. | |
| 6,669,530 | B2 | 12/2003 | Du | |
| 6,749,481 | B1 * | 6/2004 | Yap et al. | 446/213 |
| 6,761,157 | B2 * | 7/2004 | Bartek | 446/475 |
| 2001/0053654 | A1 | 12/2001 | Wakins | |
| 2002/0077027 | A1 | 6/2002 | Wu | |
| 2003/0024956 | A1 | 2/2003 | Crawford | |

* cited by examiner

*Primary Examiner* — Gene Kim
*Assistant Examiner* — Urszula M Cegielnik
(74) *Attorney, Agent, or Firm* — Eckert Seamans Cherin & Mellott, LLC; David C. Jenkins

(57) ABSTRACT

A horn having a substantially hollow body with a first end, a medial portion, and a second end. The medial portion has an exhaust assembly having an opening. The body first end is structured to be engaged by the mouth of a user and defines an initial flowpath with a direction extending into the body. A confetti chamber is disposed in the hollow body. The confetti chamber is in fluid communication with the body first end and the exhaust opening. There is confetti disposed in the confetti chamber. An exhaust flowpath extends from the confetti chamber through said exhaust opening. The exhaust flowpath is not substantially aligned with said initial flowpath.

25 Claims, 2 Drawing Sheets

CONFETTI PARTY HORN

BACKGROUND OF THE INVENTION

1. Field of the Invention

This invention relates to a toy horn typically associated with celebrations and/or parties, and, more specifically, a horn structured to produce a burst of confetti when blown.

2. Description of the Prior Art

Holidays or other events are often celebrated with party favors such as noisemakers and confetti. One common noisemaker is a toy horn or "party horn." Such a party horn typically has an elongated, hollow body with a noise-making device, such as a whistle or vibratile reed, at one end and an opening at the other end. The body may be shaped as a frustum to amplify the celebratory noise. Confetti is typically small pieces of paper or other lightweight material that floats slowly downwardly when tossed in the air. Confetti is typically tossed upwardly to maximize the float time.

Party horns and confetti have been combined in the past. For example, as disclosed in U.S. Pat. No. 1,491,809, a party horn is disclosed having a tissue barrier over the wide end of the body and confetti placed in the space between the noise-making mouthpiece and the closed end. A user could remove the mouthpiece and blow on the narrow end of the body causing the confetti to break the tissue barrier and be expelled rapidly outward. The user could then replace the mouthpiece and use the device as a typical party horn. Other devices eliminated the step of removing the mouthpiece and allowed the user to both make noise and expel the confetti with one breath.

The disadvantage of confetti party horns such as these is that the confetti was expelled in a direction aligned with the direction of the initial flowpath of the user's breath. That is, if a user held her head in a typical upright position, the horn extended in a generally horizontal direction. If the confetti was expelled in a horizontal direction it would quickly fall to the ground and may even hit another person. To expel the confetti in an upward direction, the user would have to tilt her head back so that the horn extended upwardly. However, in this position, the confetti was prone to fall into the user's mouth or block the air passages of the noisemaker.

Another disadvantage with the prior art confetti party horns was that the barrier used to retain the confetti was ruined after one use and confetti could easily fall from the horn. That is, when removing a party horn from one's mouth, a user typically held the narrow end and allowed the wide end to drop first so that the wide end faced downwardly. Thus, if all of the confetti was not expelled in the initial use of the horn when the user removed the horn from her mouth the confetti would simply fall to the ground.

There is therefore, a need for a confetti party horn that allows the user to expel confetti in a direction other than a direction aligned with the flow path of the user's breath.

There is a further need for a party horn that is structured to resist having confetti escape the horn when the horn is not in use.

SUMMARY OF THE INVENTION

These needs, and others, are met by at least one embodiment of the present invention which provides for a party horn having hollow body with a first end, a medial portion and a second end. The first end is structured to be engaged by the mouth of a user and defines an initial flowpath having a first direction. The medial portion of the body includes a confetti chamber having an opening. The opening is not substantially aligned with the initial flowpath. With a typical frustum-shaped party horn, the opening extends in a plane substantially parallel with the direction of the initial flowpath so that the exhaust flowpath is substantially normal to the direction of the initial flowpath. That is, when the horn body is frustum shaped, the horn body extends substantially parallel with the direction of initial flowpath. The opening is preferably an opening through the horn body. The second end of the horn is closed. Confetti is disposed in the medial portion of the body. In this configuration, when a user positions the opening on the upper side of the horn body and blows, the user's breath passes along the initial flowpath into the confetti chamber, where confetti is commingled with the fluid flow, and is expelled through the upwardly facing, lateral opening. Thus, the confetti in the fluid flow is expelled upwardly. Further, because the opening is on a lateral side of the body, it is less likely that confetti will fall therefrom when the user removes the horn from their mouth.

The party horn may include other elements typically found on such horns such as a noisemaker in the first end and a decorative frill at the second end. Other elements of the party horn may include a fluid permeable barrier, but confetti resistant barrier at the first end. Such a barrier allows for the user's breath to pass therethrough, but resists confetti blocking, or falling from, the first end. The horn may also include a generally solid barrier at the second end. Such a second barrier allows the body to maintain a conical frustum shape over the entire length.

In another embodiment, the opening includes a removable seal assembly. Such a seal assembly maintains the confetti in the confetti chamber prior to use. The seal assembly may be tissue, or some other easily punctured material, a removable cover held on by a frangible tab or, more preferably, a resealable trapdoor. The removable seal assembly is impermeable to the confetti.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, the words "upstream" and "downstream" is used in association with a typical fluid flow through the horn. That is, the point where the user blows into the horn is the "upstream" end and the point where the user's breath exits the horn is the "downstream" end.

Figure 1:
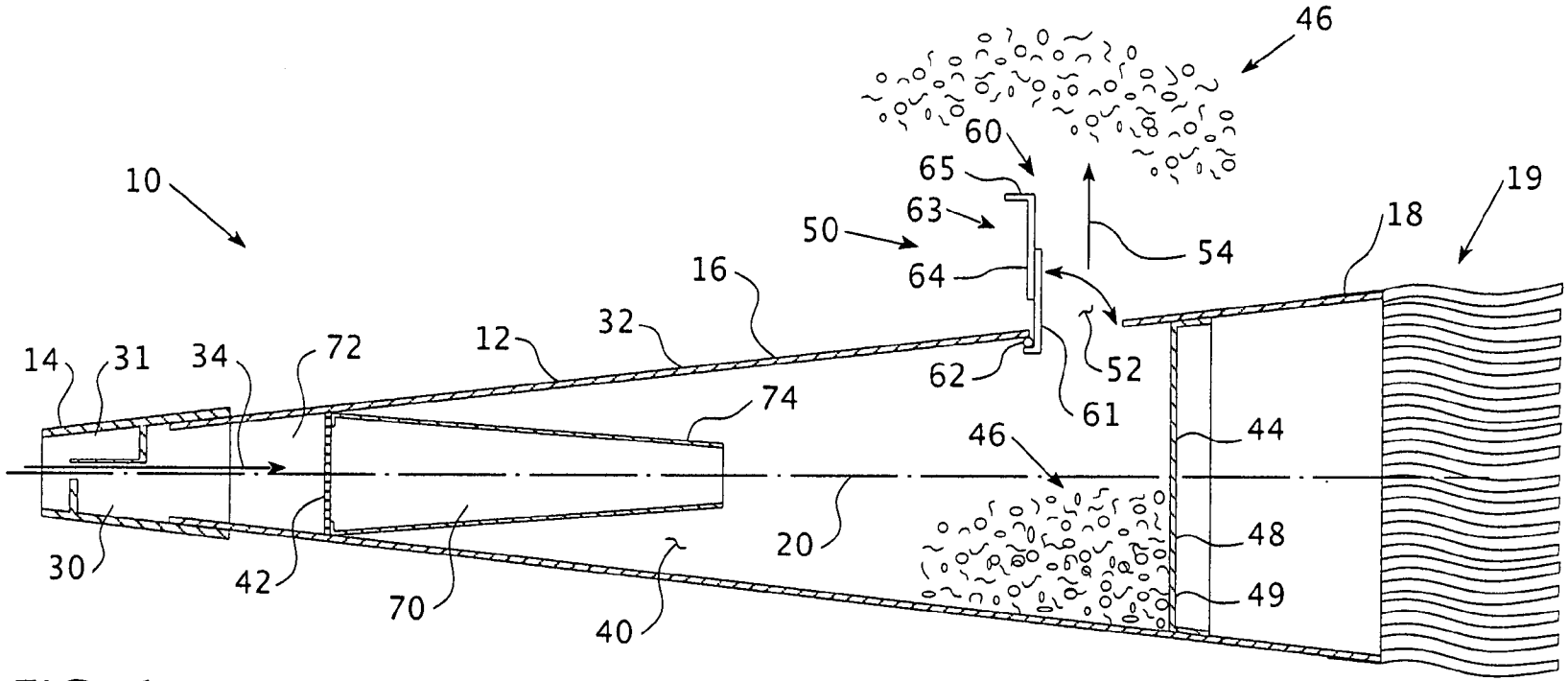
FIG. 1 is a partial cross-sectional side view of one embodiment of the horn.

As shown in FIG. 1, a horn 10 includes a substantially hollow body 12 having a first end 14, a medial portion 16, and a second end 18. The body 12 may have any shape, but preferably is an elongated conical frustum having a longitudinal axis 20 with the first end 14 being the narrow end and the second end 18 being the wide end. The first end 14 is structured to be engaged by the mouth of a user and, preferably, includes a noise making device 30. The noise making device 30 may be a whistle, vibratile reed, or similar device as is known in the art. The body 12 may include a separate noise making device 31, typically plastic, coupled to a sidewall 32, typically cardboard, defining the elongated portion of the body 12. The body first end 14, therefore, defines an initial flowpath 34 with a direction extending into the body 12. In the preferred embodiment with an elongated body 12, the initial flowpath 34 extends along, or in a direction generally aligned with, the longitudinal axis 20.

The body medial portion 16 of the body 12 defines a confetti chamber 40. Preferably, the confetti chamber 40 is bounded at the body first end 14 by a first barrier 42 and may be bounded adjacent to the body second end 18 by a second barrier 44, both described below. Within the confetti chamber 40 is a quantity of confetti 46. The confetti chamber 40 is in fluid communication with the body first end 14. The body medial portion 16 further includes an exhaust assembly 50 having an opening 52. In the simplest embodiment, the exhaust assembly 50 consists solely of the exhaust assembly opening 52, but, as described below, the exhaust assembly 50 may also include a removable seal assembly 60. The exhaust assembly opening 52 extends through the body sidewall 32. Thus, in the preferred embodiment shaped as a conical frustum wherein the sidewall 32 extends substantially parallel to the longitudinal axis 20, the exhaust assembly opening 52 is a portion of a conic surface that is also substantially parallel to the longitudinal axis 20. Thus, the exhaust assembly opening 52 may be described as a "lateral opening." The confetti chamber 40 is also in fluid communication with the exhaust assembly opening 52 and an exhaust flowpath 54 extends from the confetti chamber 40 through the exhaust assembly opening 52. Given the orientation of the exhaust assembly opening 52, the exhaust flowpath 54 is not substantially aligned with the initial flowpath 34.

The first barrier 42 is disposed adjacent to the body first end 14, preferably at the downstream end of the noise making device 30. The first barrier 42 is substantially permeable to fluid flow and substantially impermeable to the confetti 46. That is, a user's breath may pass freely through the first barrier 42 while the confetti 46 may not. The first barrier 42, preferably, is a mesh having a size between about 8 mesh to 30 mesh.

The body second end 18 is closed. Where the body 12 does not have a conical frustum shape, the second end 18 may be "pinched" together. However, as this shape is not the traditional horn shape, in a preferred embodiment, the body second end 18 maintains a conical frustum shape and the body second end 18 is substantially closed by the second barrier 44. The second barrier 44 is disposed between the exhaust assembly opening 52 and the body second end 18. The second barrier 44 is substantially impermeable to the confetti 46. The second barrier 44 may be a solid planar member 48, such as, but not limited to, a cardboard disk 49. The planar member 48 is coupled about the periphery to the inner surface of the sidewall 32 adjacent to the body second end 18. The planar member 48 may extend generally perpendicular to the longitudinal axis 20 or may be tilted relative thereto. If the planar member 48 is tilted relative to the longitudinal axis 20, the downstream edge of the planar member 48, that is, the edge most distant from the first end 14, is preferably adjacent to the exhaust assembly opening 52. The body second end 18 may include a decorative frill 19 that substantially obscures the second barrier 44 from view.

In this configuration, the horn 10 operates as follows. The user positions the horn 10 with the body first end 14 in the user's mouth and oriented so that the exhaust assembly opening 52 is disposed generally at the top side of the horn 10. The user then exhales through the body first end 14 creating a fluid flow that travels along the initial flowpath 34. If the body first end 14 includes a noise making device 30, the noise making device 30 will be actuated by the fluid flow passing therethrough. The fluid flow then passes into the confetti chamber 40. In the confetti chamber 40 natural turbulence will cause the confetti 46 to become intermingled with the fluid flow. The commingled confetti 46 fluid exits the confetti chamber 40 via the exhaust flowpath 54. That is, the commingled confetti 46 fluid pass through the exhaust assembly opening 52. Once the commingled confetti 46 fluid passes through the exhaust assembly opening 52, the confetti 46 disburses into the atmosphere in a pleasing manner. Depending upon the amount of confetti 46 initially disposed within the confetti chamber 40, it is possible that less than the entire amount of confetti 46 will be expelled in a single use. Thus, the horn 10 may be reused to create a confetti 46 burst until the confetti chamber 40 is empty. Once the confetti chamber 40 is empty, the horn 10 may be used as a traditional noisemaker.

The horn 10 may include further elements. In one embodiment, the body 12 includes an elongated, hollow, inner tubular member 70 disposed within the body 12. The inner tubular member 70 has a first end 72 and a second end 74. The inner tubular member first end 72 is coupled to the inner surface of the body 12 adjacent to the body first end 14. Preferably, the coupling device, such as, but not limited to, a friction fit or a glue, seals the inner tubular member 70 against the body 12. Thus, the initial flowpath 34 extends through the inner tubular member 70. The inner tubular member 70 further extends in the direction of the initial flowpath 34 so that the inner tubular member second end 74 is disposed within the confetti chamber 40. Preferably, the inner tubular member 70 is a generally conical frustum wherein the inner tubular member first end 72 is the wide end. Thus, the inner tubular member second end 74 is the narrow end. In this configuration, the speed of the fluid flow is increased just as the fluid flow enters the confetti chamber 40. As such the fluid flow is more likely to pick up, and mix with, the confetti 46.

The horn 10, and more specifically the exhaust assembly 50, may also include a removable seal assembly 60 as noted above. The removable seal assembly 60 is structured to substantially maintain the confetti 46 in the confetti chamber 40 prior to use. The removable seal assembly 60 is, preferably, structured to be reusable so that a user may close the confetti chamber 40 between uses. Thus, in the preferred embodiment, the removable seal assembly 60 includes a trapdoor 61. The trapdoor 61 extends across substantially all of the exhaust assembly opening 52. The trapdoor 61 is coupled to the body 12 by a hinge 62, such as, but not limited to, a living hinge. The trapdoor 61 is structured to move between a first position, wherein said trapdoor 61 substantially blocks the exhaust assembly opening 52, and a second position, wherein said trapdoor 61 does not block the exhaust assembly opening 52. Preferably, the trapdoor 61 is pulled away from the confetti chamber 40 when moved into the second position. The trapdoor 61 may also be held in place by a removable adhesive tape 63. The tape 63 may also be structured to be grasped by the user. That is, the tape 63 may have an adhesive portion 64, which extends across both the body 12 and the trapdoor 61, and a non-adhesive portion 65 that extends away from the body 12. As such, the non-adhesive portion 65 may be used as a handle for the user to grasped or pinched. In this configuration, the user must open the trapdoor 61 prior to using the horn 10 and, once the use is complete, the user may reclose the trapdoor 61 thereby substantially preventing the accidental discharge of confetti 46.

Figure 2:
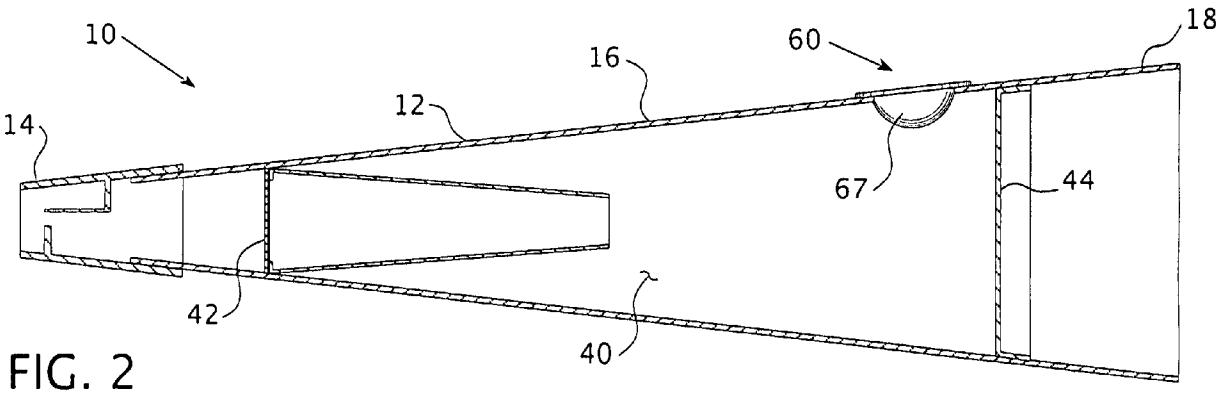
FIG. 2 is detailed view of an alternate exhaust assembly.
Figure 3:
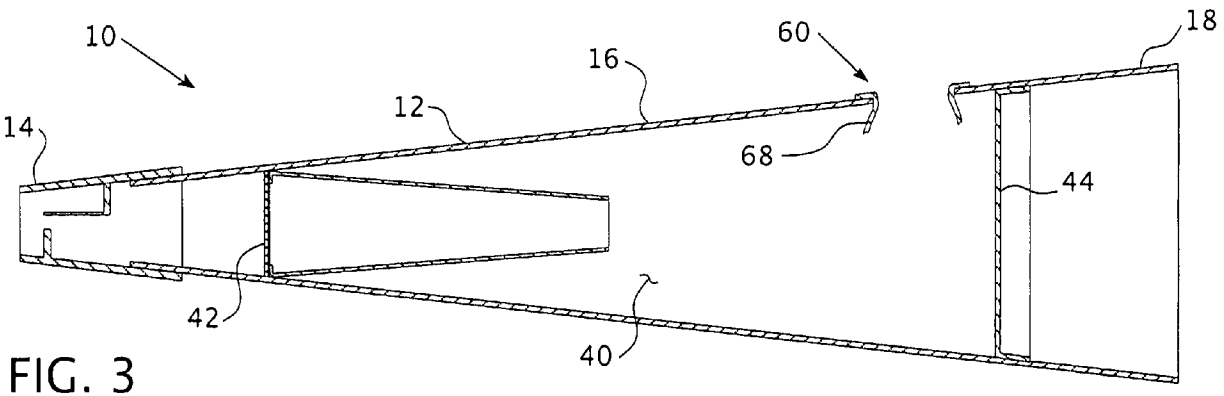
FIG. 3 is detailed view of an alternate exhaust assembly.

In an alternate embodiment, the trapdoor 61 may be initially held in place by a frangible tab 66 located on the opposite side of the trapdoor 61 from the hinge 62. To open the trapdoor 61, the user pushes the trapdoor 61 into the confetti chamber 40 while breaking the frangible tab 66. In another embodiment shown in FIG. 2, the removable seal assembly 60 is a removable member 67 that is structured to be detached from the body 12. For example, if the body 12 is made from cardboard, the exhaust assembly opening 52 may be formed by perforating a portion of the body 12. That is, the perforated portion of the body 12 has multiple frangible tabs surrounding the removable member 67. The user may open the exhaust assembly opening 52 by removing the removable member 67. In another alternate embodiment shown in FIG. 3, the removable seal assembly 60 includes a tearable member 68 that is structured to be punctured by a user. The tearable member 68 is a thin material, such as, but not limited to, tissue paper or a plastic film. In this embodiment, the user may open the exhaust assembly opening 52 by puncturing the tearable member 68. As shown, the tearable member 68 has been torn and pushed partially into the confetti chamber 40.

The confetti 46 may be cut into a shape associated with a specific celebration. That is, while the confetti 46 may be small pieces of paper having one or more colors, the confetti 46 may also be cut in specific shapes. The desired shape of the confetti 46 depends upon the holiday or event. For example, for Halloween, the confetti 46 may be shaped as pumpkins or ghosts, for St. Patrick's Day, the confetti may be shaped as shamrocks, for a birthday or anniversary, the confetti 46 may be shaped in the number corresponding to the appropriate number of years being commemorated.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

The invention claimed is:

1. A horn comprising:

a substantially hollow body having a first end, a medial portion, and a second end;

said medial portion having an exhaust assembly having an opening;

said body first end structured to be engaged by the mouth of a user and said first end defining an initial flowpath with a direction extending into said body;

a confetti chamber disposed in said hollow body, said confetti chamber in fluid communication with said body first end and said exhaust assembly opening;

confetti disposed in said confetti chamber; and wherein an exhaust flowpath extends from said confetti chamber through said exhaust assembly opening, and wherein said exhaust flowpath is not substantially aligned with said initial flowpath.

2. The horn of claim 1 wherein:

said confetti chamber includes a first barrier and a second barrier;

said first barrier being substantially permeable to fluid flow and substantially impermeable to said confetti, said first barrier disposed adjacent to said body first end; and said second barrier being substantially impermeable to said confetti, said second barrier being disposed between said exhaust assembly opening and said body second end.

3. The horn of claim 2 wherein said second barrier is substantially impermeable to fluid flow.

4. The horn of claim 2 wherein said body first end includes a noise making device.

5. The horn of claim 1 wherein said exhaust assembly includes a removable seal assembly, said seal assembly being substantially impermeable to said confetti.

6. The horn of claim 5 wherein said removable seal assembly is a trapdoor structured to move between a first position, wherein said trapdoor substantially blocks said exhaust assembly opening, and a second position, wherein said trapdoor does not block said exhaust assembly opening.

7. The horn of claim 6 wherein said trapdoor is initially held in said first position by a removable adhesive tape.

8. The horn of claim 6 wherein said trapdoor is initially held in said first position by a frangible tab.

9. The horn of claim 5 wherein said removable seal assembly is a tearable member disposed over said exhaust assembly opening, said tearable member being structured to be punctured by a user and thereby allow passage of said confetti through said exhaust assembly opening.

10. The horn of claim 5 wherein said removable seal assembly is a removable member disposed over said exhaust assembly opening, said removable member being structured to be detached from said body by a user and thereby allow passage of said confetti through said exhaust assembly opening.

11. A horn comprising:

an elongated substantially hollow body having a longitudinal axis, a first end, a medial portion, and a second end;

said medial portion having an exhaust assembly with a lateral opening;

said body first end structured to be engaged by the mouth of a user;

said first end defining an initial flowpath extending in a direction generally aligned with said body longitudinal axis;

a confetti chamber disposed in said hollow body, said confetti chamber in fluid communication with said body first end and said exhaust assembly opening;

confetti disposed in said confetti chamber; and wherein an exhaust flowpath extends from said confetti chamber through said exhaust opening, and wherein said exhaust flowpath is not substantially aligned with said body longitudinal axis.

12. The horn of claim 11 wherein:

said body is a generally conical frustum wherein said first end is the narrow end;

said body includes an elongated inner tubular member disposed within said body, said inner tubular member having a first end and a second end;

said inner tubular member first end coupled to said body adjacent to said body first end so that said initial flowpath extends through said inner tubular member;

said inner tubular member further extending in the direction of said initial flowpath whereby said inner tubular member second end is disposed within said confetti chamber; and said inner tubular member is a generally conical frustum wherein said first end is the wide end.

13. The horn of claim 12 wherein:

said confetti chamber includes a first barrier and a second barrier;

said first barrier being substantially permeable to fluid flow and substantially impermeable to said confetti, said first barrier disposed adjacent to said body first end and within said inner tubular member;

said second barrier being substantially impermeable to said confetti, said second barrier being disposed between said exhaust assembly opening and said body second end; and;

wherein said second barrier is substantially impermeable to fluid flow.

14. The horn of claim 13 wherein said body first end includes a noise making device.

15. The horn of claim 12 wherein said exhaust assembly includes a removable seal assembly, said seal assembly being substantially impermeable to said confetti.

16. The horn of claim 15 wherein said removable seal assembly is a trapdoor structured to move between a first position, wherein said trapdoor substantially blocks said exhaust assembly opening, and a second position, wherein said trapdoor does not block said exhaust assembly opening.

17. The horn of claim 16 wherein said trapdoor is initially held in said first position by a removable adhesive tape.

18. The horn of claim 16 wherein said trapdoor is initially held in said first position by a frangible tab.

19. The horn of claim 15 wherein said removable seal assembly is a tearable member disposed over said exhaust assembly opening, said tearable member being structured to be punctured by a user and thereby allow passage of said confetti through said exhaust assembly opening.

20. The horn of claim 15 wherein said removable seal assembly is a removable member disposed over said exhaust assembly opening, said removable member being structured to be detached from said body by a user and thereby allow passage of said confetti through said exhaust assembly opening.

21. A horn comprising:

an elongated substantially hollow body having a longitudinal axis, a first end, a medial portion, and a second end;

said body first end structured to be engaged by the mouth of a user and includes a noise making device;

said medial portion defining a confetti chamber having an exhaust assembly with an opening;

said second end being closed;

confetti disposed in said confetti chamber; and wherein an exhaust flowpath extends from said confetti chamber through said exhaust assembly opening, and wherein said exhaust flowpath is not substantially aligned with said body longitudinal axis.

22. The horn of claim 21 wherein said confetti is cut into a shape associated with a specific celebration.

23. The horn of claim 21 wherein said exhaust assembly includes a removable seal assembly disposed over said exhaust assembly opening, said seal assembly being substantially impermeable to said confetti.

24. The horn of claim 23 wherein said removable seal assembly is a trapdoor structured to move between a first position, wherein said trapdoor substantially blocks said exhaust opening, and a second position, wherein said trapdoor does not block said exhaust opening.

25. The horn of claim 24 wherein said trapdoor is initially held in said first position by a removable adhesive tape.

* * * * *